United States Patent [19]

Mensik

[11] Patent Number: 4,517,989

[45] Date of Patent: May 21, 1985

[54] CIGARETTE HOLDER AND FILTER CARTRIDGE

[76] Inventor: John A. Mensik, 124 Creekdale Rd., Walnut Creek, Calif. 94595

[21] Appl. No.: 495,669

[22] Filed: May 18, 1983

[51] Int. Cl.[3] ..... A24D 3/04; A24F 7/00; A24F 7/02; A24F 7/04

[52] U.S. Cl. ..... 131/187; 131/201; 131/210; 131/216

[58] Field of Search ..... 131/201, 198 R, 198 A, 131/216, 187, 210, 216, 192

[56] References Cited

U.S. PATENT DOCUMENTS 3,926,199 12/1975 Thomas ..... 131/187

4,292,983 10/1981 Mensik ..... 131/187

*Primary Examiner*—V. Millin

*Attorney, Agent, or Firm*—Ernest M. Anderson

[57] ABSTRACT

An improved construction for a cigarette holder and filter cartridge is described wherein the holder has a unique arrangement of cavities for axially receiving a filter cartridge and the end of a cigarette. The filter cartridge is formed with a unique arrangement of surfaces and a conical frustum for reception and retention in the holder. The location and taper of the frustum cooperates with one of the cavities of the holder to provide a flexible binding fit, allowing the cartridge to be retained in the holder during normal use and changes in cigarettes, but removable by simply tapping the end of the holder against a hard supporting surface.

4 Claims, 2 Drawing Figures

CIGARETTE HOLDER AND FILTER CARTRIDGE

This invention relates to cigarette holders and filter cartridges and to a novel construction that allows the filter cartridge to be easily and rapidly replaced. Most conventional cigarette holders that accomodate filter cartridges have a two piece construction. One piece is formed as a mouthpiece and the other as the cigarette holder. Either of the two pieces may provide a cavity for receiving the filter cartridge which is captivated by adjoining the two pieces together.

The present invention provides an integral cigarette holder and mouthpiece that receives and retains a filter cartridge insertable through the end that holds the cigarette. The problem solved by the invention is in providing a construction that retains the filter cartridge within the holder and mouthpiece during ordinary use and periodic replacement of cigarettes without inadvertent dislodgement but also allows the filter cartridge to be easily removed and replaced by a new filter cartridge.

A principal object of the present invention, then, is to provide a single piece cigarette holder and mouthpiece that also is capable of receiving a filter cartridge and retaining the filter cartridge during ordinary use.

Various other objects of the invention will become apparent in view of the following detailed description.

Figure 1:
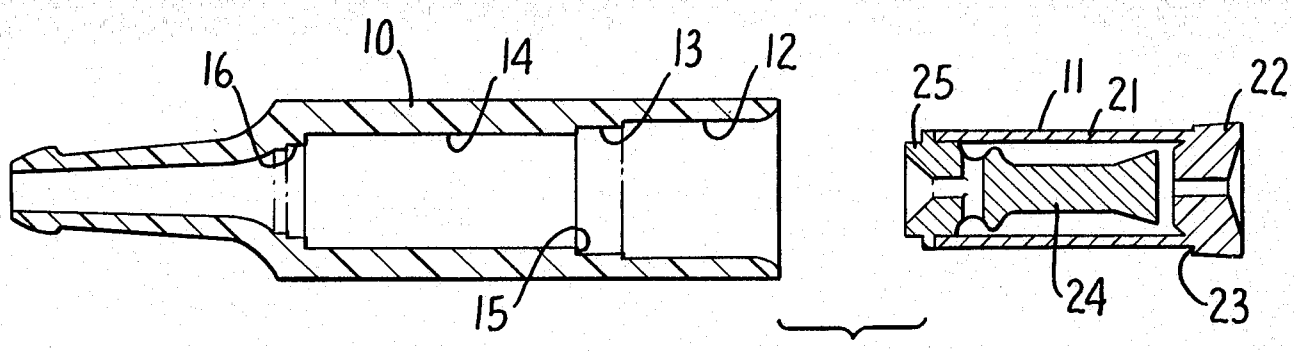
FIG. 1 is a preferred embodiment of the invention in a cigarette holder and mouthpiece and a filter cartridge positioned for axial assembly therein, each shown in longitudinal section.
Figure 2:
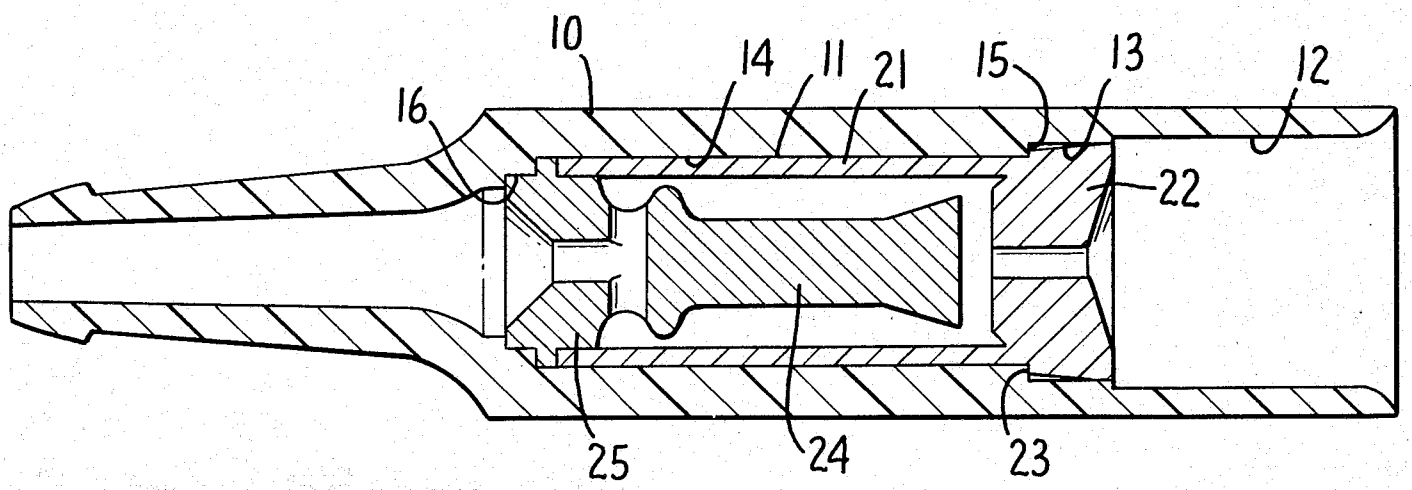
FIG. 2 is an enlarged longitudinal section of the two parts assembled.

Referring to FIGS. 1 and 2, there is shown a cigarette holder and mouthpiece 10 and a filter cartridge 11. These pieces are formed to mate with the other, the cartridge 11 being received within the holder as shown in FIG. 2. More particularly, holder 10 is formed with cylindrical or tapered cavity surfaces of varying diameter sizes. The outermost cavity 12 is dimensioned to receive the end of a cigarette, which is approximately 3/10 of an inch diameter. Inasmuch as the end size of a cigarette varies and is dependent upon the manufacturer, cavity 11 may be slightly tapered. The largest diameter may be in the order of 0.302 inch and the innermost diameter of this cavity may be 0.297 inch. This allows the cavity to hold a variety of the most popular cigarettes.

A second cylindrical cavity 13 is formed within the holder, this cavity being located and formed to cooperate with cartridge 11 and to grip the cartridge once it is fully inserted as shown in FIG. 2. The diameter of the cavity, although not critical, is less than that of the minimum diameter of cavity 12 and sized to create a friction or binding fit with one surface of the filter cartridge as hereinafter described.

A third cavity 14 is formed to receive the main body of the filter cartridge. The diameter of this cavity is dimensioned larger than the corresponding dimension of the cartridge when installed and yet smaller than the diameters of cavities 12 and 13. This produces a step within the holder at the point indicated at 15 where cavities 13 and 14 come together. The step that is so formed serves as a stop for limiting the axial insertion of the filter cartridge.

A fourth cavity 16 may also be provided to receive and support the end of the cartridge first inserted in the holder. The diameter is appropriately sized on the basis of the construction of the filter cartridge but the use of such a cavity is not required for practicing the invention herein described.

Filter cartridge 11 is made substantially in accordance with the teaching of U.S. Pat. No. 4,292,983. Thus, details of the filter construction and its operation are not to be regarded as part of this invention. Notwithstanding, the housing for filter cartridge 11 is uniquely formed to be received through cavity 12 and housed within cavities 13, 14 and 16 as shown in FIG. 2. Most importantly, the housing of filter cartridge 11 comprises a sleeve 21 integrally formed with a conical frustum 22. The frustum has a greater circumference than the sleeve and is tapered inwardly toward the sleeve. It is preferred that an abrupt change in diameter be provided at point 23 where the frustum connects to sleeve 21, thus providing an exterior step that engages the step between surfaces 13 and 14 at point 15 and limiting insertion of the filter to the point of contact.

The largest circumference of frustum 22 is selected to make a frictional fit within cavity 13. The axial length of the conical frustum is relatively short so that a frictional or binding fit occurs within a relatively short axial movement. Based on variations in size of manufactured parts, which may be attributable to changes in material and their resiliency, it has been determined empirically that the axial length of conical frustum 22 may be $\frac{1}{8}$ inch or less. In any event, the length of the frustum 22 and the length of cavity 13 with which it mates is substantially less than the axial length of cavity 12 which is required to support a cigarette.

With the holder and cartridge described, the filter is freely received through the open end of cavity 12 until frustum 22 engages the surface of cavity 13. At this point, the cartridge may be further inserted by applying a slight axial force—as with a cigarette—until the stepped surfaces of cartridge and holder make contact. This binding fit is made with only a slight axial movement of $\frac{1}{8}$ inch or less. The procedure for removing the cartridge is also simple. Tapping the open end of the holder against a hard supporting surface will dislodge the frustum from cavity 13 and the cartridge is removed by gravity alone.

In the preferred embodiment shown, filter cartridge 11 also comprises a filter element 24 integrally formed on a closure plug 25. The end of closure plug 25 is adapted to be received within the cavity 16 of the holder.

Both cigarette holder and mouthpiece 10 and filter cartridge 11 may be manufactured of plastic materials using conventional molding techniques. The flexibility and resiliency of such materials are desirable qualitifes which are useful in providing a binding fit between the frustum 22 and cavity 13. It is preferred that the holder and mouthpiece be made of a fairly rigid plastic material such as styrene, while the housing of the filter cartridge is made of polypropylene, a more flexible material. The selection of these materials has been determined as particularly suitable for purposes of this invention.

Although a preferred embodiment of the invention has been illustrated and defined, various modifications and changes may be made without departing from the spirit of the invention or the scope of the appended claims, and each of such modifications and changes is contemplated.

What is claimed is:

1. A cigarette holder and a filter cartridge, said holder having a first cavity at one end for axially receiving the end of a cigarette and a second cylindrical inner cavity of lesser diameter for axially receiving the filter cartridge, said filter cartridge having a housing formed with a flexible conical frustum at one end and a cylindrical sleeve, said frustum having greater circumference than said sleeve and being tapered inwardly towards the sleeve, the largest circumference of said frustum being larger than the circumference of said cylindrical inner cavity but receivable therein with a flexible binding fit due to the flexibility of said flexible conical frustum; whereby said filter cartridge may be inserted into said holder through the first cavity and said frustum lodged in said cylindrical inner cavity with a flexible binding fit.

2. The improvement of claim 1, said cigarette holder and mouthpiece being rigid and molded from plastic, said filter housing being molded from plastic more flexible than that of said holder.

3. The improvement of claim 1, the length of said first cavity being substantially greater than the lengths of said second cylindrical inner cavity and said conical frustum of said housing, the length of said conical frustum being relatively short to release the filter cartridge from a binding fit by tapping the end of the holder against a hard supporting suface.

4. The improvement of claim 1, the lengths of said conical frustum and said second cylindrical inner cavity being approximately $\frac{1}{8}$ inch or less.

* * * * *